US007950092B2

(12) United States Patent
Watchorn et al.

(10) Patent No.: US 7,950,092 B2
(45) Date of Patent: May 31, 2011

(54) ACCESS METHOD BETWEEN MARINE STRUCTURES AND APPARATUS

(75) Inventors: Michael John Watchorn, Stocksfield (GB); Timothy William Grinsted, Stocksfield (GB)

(73) Assignee: IHC Engineering Business Limited (GB)

( * ) Notice: Subject to any disclaimer, the term of this patent is extended or adjusted under 35 U.S.C. 154(b) by 898 days.

(21) Appl. No.: 10/578,703

(22) PCT Filed: Nov. 9, 2004

(86) PCT No.: PCT/GB2004/004716

§ 371 (c)(1),
(2), (4) Date: Jul. 10, 2006

(87) PCT Pub. No.: WO2005/047097

PCT Pub. Date: May 26, 2005

(65) Prior Publication Data

US 2007/0050929 A1 Mar. 8, 2007

(30) Foreign Application Priority Data

Nov. 10, 2003 (GB) ..... 0326147.6
Feb. 16, 2004 (GB) ..... 0403362.7
Aug. 3, 2004 (GB) ..... 0417279.7

(51) Int. Cl.
*E01D 15/00* (2006.01)

(52) U.S. Cl. ..... 14/2.4; 14/71.1; 14/71.3

(58) Field of Classification Search ..... 14/2.4, 14/69.5, 71.1, 71.3, 77.1; 114/230.1
See application file for complete search history.

(56) References Cited

U.S. PATENT DOCUMENTS 785,400 A * 3/1905 Buchanan ..... 198/593
2,568,330 A * 9/1951 Flippin ..... 114/382
2,617,131 A * 11/1952 Harris ..... 14/71.1
2,641,785 A * 6/1953 Pitts et al. ..... 14/71.1
3,228,051 A * 1/1966 Voase et al. ..... 14/71.1
3,385,455 A * 5/1968 Eugenio ..... 212/343
3,426,719 A * 2/1969 Leonard ..... 14/71.7
3,468,280 A * 9/1969 Williams ..... 114/72
3,589,299 A * 6/1971 Ingram ..... 104/114
3,707,922 A * 1/1973 Dillon ..... 104/114
3,727,650 A * 4/1973 Ingram et al. ..... 141/98
(Continued)

FOREIGN PATENT DOCUMENTS

GB 2 158 793 A 11/1985
(Continued)

*Primary Examiner* — Gary S Hartmann
(74) *Attorney, Agent, or Firm* — Ryan A. Schneider, Esq.; Troutman Sanders LLP

(57) ABSTRACT

Access means are provided for accessing a fixed offshore structure such as a wind turbine (70), larger vessel or the like form a smaller transfer vessel (50), or for providing for transfer between vessels One or more guide wires (12) are connected from the vessel (50) to the fixed structure (70) or second vessel and placed in tension such as by directing the transfer vessel away from the fixed structure. In one embodiment, inflatable, members are suspendable from the guide wires and inflation of the inflatable members causes them to extend along the guide wires to form an access surface (56) across which personnel may walk to access the fixed structure or second vessel from the first vessel Mounting means are also provided which accommodate relative rotational, translational and pitching movement of the apparatus and vessel, caused by wave motion. In another embodiment, a bridge member is retained on a runway of the first vessel and deployed using said guide wires (12).

7 Claims, 8 Drawing Sheets

U.S. PATENT DOCUMENTS

| | | | | |
|---|---|---|---|---|
| 3,945,508 | A * | 3/1976 | Colin | 414/138.4 |
| 4,011,615 | A * | 3/1977 | Maxson et al. | 14/71.1 |
| 4,083,072 | A * | 4/1978 | Ryan | 14/69.5 |
| 4,162,551 | A * | 7/1979 | Serrano | 14/69.5 |
| 4,169,296 | A * | 10/1979 | Wipkink et al. | 14/71.1 |
| 4,363,150 | A * | 12/1982 | Nilsson | 14/69.5 |
| 4,369,538 | A * | 1/1983 | Smedal | 14/69.5 |
| 4,590,634 | A * | 5/1986 | Williams | 14/71.1 |
| 4,742,590 | A * | 5/1988 | Glassman et al. | 14/2.4 |
| 5,624,292 | A * | 4/1997 | Wiseman, Jr. | 441/80 |
| 6,418,582 | B1 * | 7/2002 | Petit | 14/71.5 |
| 6,435,795 | B1 | 8/2002 | Brady | |
| 6,739,430 | B2 * | 5/2004 | Hill | 187/245 |
| 6,955,134 | B2 * | 10/2005 | Prins | 114/230.17 |
| 2002/0083881 | A1 | 7/2002 | Arias | |
| 2003/0182741 | A1 | 10/2003 | Prins | |
| 2008/0145149 | A1 * | 6/2008 | Grinsted et al. | 405/1 |
| 2008/0229524 | A1 * | 9/2008 | Watchorn et al. | 14/69.5 |
| 2008/0301888 | A1 * | 12/2008 | Watchorn et al. | 14/71.1 |

FOREIGN PATENT DOCUMENTS

| | | | |
|---|---|---|---|
| GB | 2 225 753 | A | 6/1990 |
| GB | 2 246 992 | A | 2/1992 |

* cited by examiner

ACCESS METHOD BETWEEN MARINE STRUCTURES AND APPARATUS

This application is a U.S. National Phase of International Patent Application Serial No. PCT/GB2004/004716, filed Nov. 9, 2004 which claims priority to GB Patent Application No. 0326147.6 filed Nov. 10, 2003; GB Patent Application No. 0403362.7 filed Feb. 16, 2004 and GB Patent Application No. 0417279.7 filed Aug. 3, 2004.

BACKGROUND OF THE INVENTION

The present invention relates to method and apparatus for providing access between marine structures, and more especially for providing access from a vessel, such as a relatively small vessel, to a relatively larger vessel or to a fixed offshore structure, or between two vessels, especially larger vessels. In the case of transfer between vessels, the invention is particularly advantageous when the vessels are in open water and/or under way. Said access may be, or may Include, the transfer of personnel and/or the transfer of goods and equipment.

When at sea, or on similar large body of water such as larger lakes, it is often necessary for personnel or equipment to transfer from one "marine structure" to another. In the context of this application, the term "marine structure" refers to: each of two vessels of preferably of broadly similar size between which transfer is effected; or to each of a relatively small boat ("transfer vessel") employed to carry personnel and equipment to a worksite and the worksite itself. The worksite might be a larger vessel, such as when a pilot needs to board the larger vessel from a pilot boat, or a fixed offshore structure such as an oil or gas rig, wind turbine or the like where maintenance workers need access from time to time. Most preferably one of the marine structures between which transfer is effected is a vessel navigable under its own power. In the context of transfer from a relatively small transfer vessel such as an RIB and given that the motion of a larger vessel is usually much less relative to the motion of a smaller transfer vessel, the term "fixed structure" will be used hereinafter to refer to both fixed offshore structures and relatively larger vessels. "RIB" refers to a "rigid inflatable boat" also known as "RHIB" or "rigid hull inflatable boat".

Conventionally, a worker is required to step from the transfer vessel onto a flexible or rigid ladder or onto a rigid gangway at the side of the fixed structure. This is hazardous, particularly for those who are not accustomed to working in a marine environment. In all but the calmest of seas, relative motion between the transfer vessel and the fixed structure is substantial. Stepping from a moving transfer vessel onto a stationary ladder is difficult and it is easy to slip and, potentially, to fall into the water. This carries the danger of being crushed between the transfer vessel and the fixed structure. Because of the motion of waves and the effect of currents it is, in any case, difficult to keep the transfer vessel on station, i.e. in the correct position with respect to the fixed structure, and there is also the danger of collision between the transfer vessel and the fixed structure.

Transfer between two vessels, even those of generally comparable or similar size, can be equally perilous in view of the relative motion of the vessels with respect to one another.

For these reasons, safety regulations limit the transfer of personnel from a transfer vessel to a fixed structure to times when the sea conditions are within certain parameters, typically to circumstances where the wave height is less than about 0.7 m to 1 m. The consequence of this is that many working days are lost when wave conditions are such that access to the fixed structure is not possible. This can represent a major expense for those involved in the construction and maintenance of offshore facilities.

SUMMARY OF THE INVENTION

The present invention seeks to alleviate these problems by providing a method and apparatus which allow safe access from a transfer vessel to offshore fixed structures, or between vessels, typically of generally similar size, in particular between larger vessels, especially in a greater range of sea conditions.

According to a first aspect of the present invention, there is provided a method of providing access from a first marine structure to a second marine structure comprising:

providing a gangway apparatus In a stored condition on the first marine structure;

positioning the first marine structure proximate the second marine structure;

providing at least one guide wire attached to the first marine structure, the gangway apparatus being attached or attachable to a said guide wire by means of one or more slidable fixings;

extending the at least one guide wire from the first marine structure and connecting the at least one guide wire between a location on the first marine structure and an attachment location on the second marine structure proximate the location of entry to the second marine structure;

controlling and, where necessary, adjusting the position of the first marine structure so that it is maintained in spaced apart relation to the second marine structure, and maintaining the at least one guide wire at a desired tension;

moving the gangway apparatus from the stored condition to a use condition by sliding the slidable fixing(s) along a said guide wire until the gangway apparatus spans the gap between the first marine structure and location of entry to the second marine structure.

In one preferred embodiment the gangway apparatus comprises at least one inflatable member attached to a said guide wire by said slidable fixings and transformable by inflation thereof from a compact state to an extended state, the method further comprising inflating the inflatable member with an inflating fluid thereby to cause the slidable fixings to slide along the guide wire as the inflatable member expands until the gangway apparatus spans the gap between the first marine structure and location of entry to the second marine structure.

Preferably the method further comprises providing two guide wires and connecting said guide wires between a location on the first marine structure and points on the second marine structure proximate the location of entry to the second marine structure.

In an alternative variation the method further comprises providing a single inflatable member with a guide wire at respective sides thereof.

In one preferred embodiment of the method of this aspect of invention the first marine structure is a transfer vessel and the second marine structure is a fixed structure.

In another preferred embodiment of the method of this aspect of the invention the first and second marine structures are first and second vessels.

According to a second aspect of the invention there is provided apparatus for providing a bridge structure for the transfer of personnel, goods or equipment from a first marine structure to a second marine structure comprising:

at least one inflatable member being transformable from a compact state to an extended state by inflation thereof;

attachment means for attaching the apparatus to the first marine structure;

means for inflating the inflatable member;

at least one guide wire and means for attaching the guide wire to the first marine structure the guide wire being extendable from the first marine structure and attachable to an attachment location on the second marine structure proximate the location of entry to the second marine structure;

means mounted in use on the first marine structure for maintaining a desired tension in the at least one guide wire;

a plurality of slidable fixings slidable along a said guide wire on inflation of the at least one inflatable member, by means of which fixings the at least one inflatable member is operatively suspendable from the at least one guide wire.

In one preferred variation, the apparatus comprises a single inflatable member.

In alternative preferred variations, the apparatus comprises a plurality of inflatable members which are independently inflatable.

Preferably the apparatus comprises at least one inflatable member which, in its expanded state, has an upper surface which operatively forms a walkway for personnel using the bridge structure.

In another preferred variation, the apparatus further comprises means for joining two or more Inflatable members together to form said walkway.

Preferably, said two or more inflatable members are joined in side-by-side relation.

In another preferred arrangement the apparatus further comprises inflatable members defining in their expanded state side walls of the bridge structure. Preferably, the apparatus further comprises means for joining two or more inflatable members together to form said side walls, said two or more inflatable members preferably being joined in side-by-side relation.

Where the apparatus comprises a single inflatable member, preferably an upper surface said inflatable member operatively forms a walkway for personnel using the bridge structure. In one preferred variation said upper surface includes a non-slip surface.

Preferably, the apparatus further comprises a plurality of upright posts attached at intervals to said inflatable member and ropes or nets attached to said posts.

In another preferred variation the apparatus further comprises at least one safety rope extending lengthwise of the bridge to which a user's safety harness is operatively attachable.

In one configuration of the invention, the at least one inflatable member is, in its expanded state, operatively suspended below a single guide wire.

Alternatively, the at least one inflatable member may be, in its expanded state, operatively suspended between a pair of substantially parallel guide wires.

In one preferred embodiment of this aspect of the invention the first marine structure is a transfer vessel and the second marine structure is a fixed structure.

In another preferred embodiment of this aspect of the invention the first and second marine structures are first and second vessels.

According to a third aspect of the invention there is provided a first marine structure (especially a transfer vessel) having mounted thereon apparatus defined in the second aspect of the invention. Preferably the transfer vessel comprises an inflatable boat, in particular an RIB.

According to a fourth aspect of the invention there is provided a mounting structure form mounting an apparatus as defined in the second aspect of the Invention on a vessel, comprising at least one of:

i) means for accommodating rotational movement of the vessel with respect to the apparatus;

ii) means for accommodating translational movement of the vessel with respect to the apparatus; and iii) means for accommodating pitching movement of the vessel with respect to the apparatus.

According to a fifth aspect of the invention there is provided a mounting structure for mounting an apparatus as defined in the second aspect of the invention on a vessel comprising:

a first mounting component mounted in rotationally fixed relation to the vessel a second mounting component mounted on the first mounting component and attached in rotationally fixed relation to the apparatus, the first and second mounting components being rotatable with respect to one another.

Preferably, the first and second components define a slew ring bearing.

Preferably the mounting structure further comprises a first frame element disposed between the second component and the apparatus and mounted with translational freedom of movement with respect to the second mounting component. (In less preferred variations of the invention, means for allowing translational movement between the vessel and the apparatus may be provided in the absence of the means for permitting rotational movement).

In another preferred embodiment the mounting structure further comprises biasing means adapted to bias the first frame element towards a desired location in its translational motion.

Preferably also the mounting structure further comprises a second frame element pivotally mounted with respect to the second mounting component operatively attached to the apparatus, wherein the second frame element operatively pivots about a nominally horizontal axis substantially perpendicular to the longitudinal axis of the at least one Inflatable member when extended. (Again, in less preferred variations of the invention, the above pivot means may be provided In the absence of the means for allowing rotational and/or translational movement between the transfer vessel and the apparatus). In the most preferred embodiments of this aspect of the invention means for allowing all three of rotational, translational and pivoting movement are provided.

Preferably the second frame element is pivotally mounted on the first frame element.

According to a sixth aspect of the invention there is provided transfer system comprising a mounting structure as defined above and an apparatus as defined in the second aspect of the invention attached thereto.

A seventh aspect of the invention provides a vessel, preferably a transfer vessel, having mounted thereon a mounting structure as defined above.

An eighth aspect of the invention provides a vessel, preferably a transfer vessel, having mounted thereon a transfer system according to the sixth aspect of the invention. Preferably the transfer vessel is an inflatable boat, in particular an RIB.

In another preferred embodiment of the first aspect of the invention the method further comprises providing the first marine structure with a runway and mounting the gangway apparatus on the runway in its stored condition and, when the gangway apparatus is required for use, sliding the gangway apparatus along the runway.

Preferably the gangway apparatus slides along the runway contemporaneously with the step of sliding the gangway apparatus along the guide wire(s).

Preferably at least one end portion of the gangway apparatus remains connected to the runway when the gangway apparatus is in its use condition.

Preferably in one variation of this embodiment the first marine structure is a transfer vessel and the second marine structure is a fixed structure.

Preferably in another variation of this embodiment the first and second marine structures are first and second vessels.

According to a ninth aspect of the invention there is provided an apparatus for providing a bridge structure for the transfer of personnel from a first marine structure to a second marine structure, the apparatus comprising:

a bridge member operatively moveable from a stored condition to a use condition;

a runway operatively mounted on the first marine structure and on which the bridge member is mounted in its stored condition;

at least one guide wire and means for attaching the guide wire to the first marine structure the guide wire being extendable from the first marine structure and attachable to an attachment location on the second marine structure proximate the location of entry to the second marine structure;

means mounted in use on the first marine structure for maintaining a desired tension in the at least one guide wire;

one or more first slidable fixings attached to said bridge member by means of which the bridge member is slidable along the runway from the stored condition to, or towards, the use condition;

one or more second slidable fixings attached to the bridge member and slidable along a said guide wire on deployment of the bridge member, by means of which fixings the bridge member is operatively suspendable from the at least one guide wire to span the gap between the first and second marine structures.

Preferably the runway comprises at least one rigid rail. Preferably the or each rail is rectilinear.

Alternatively, the runway may comprise one or more tensioned cables.

Preferably in one embodiment the first marine structure comprises a transfer vessel and the second marine structure comprises a fixed structure. Preferably the runway is mounted in use to extend from a highest point towards a central region of the vessel to a lowest point near the stern of the vessel.

Preferably in another embodiment the first and second marine structures are first and second vessels.

Preferably at least an end portion of the bridge member remains attached to the runway in the use condition.

In one variation embodiment the bridge member includes at least one inflatable member whereby the bridge member is transformable between contracted and expanded conditions by deflation and inflation of the inflatable member.

According to a tenth aspect of the invention there is provided a vessel, in particular a transfer vessel, having mounted thereon apparatus according to the ninth aspect of the invention. Typically, the transfer vessel is an inflatable boat, such as an RIB.

BRIEF DESCRIPTION OF THE DRAWINGS

For a better understanding of the invention and to show how the same may be carried into effect, reference will be made, by way of example only, to the following drawings, in which.

DETAILED DESCRIPTION OF THE DRAWINGS

Figure 1:
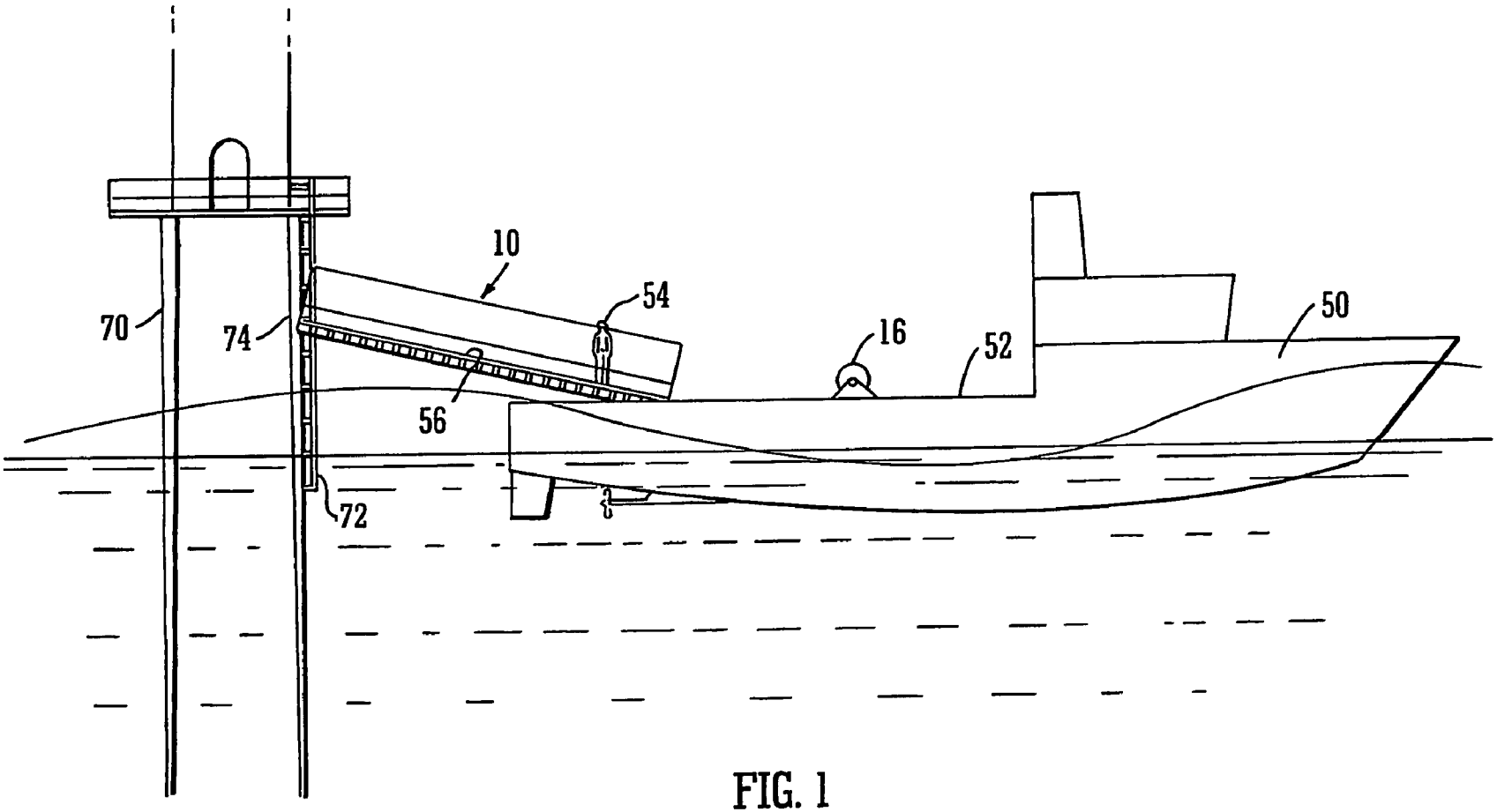
FIG. 1 is a diagrammatic representation of an apparatus of the Invention when mounted between a transfer vessel and a fixed offshore structure.
Figure 2:
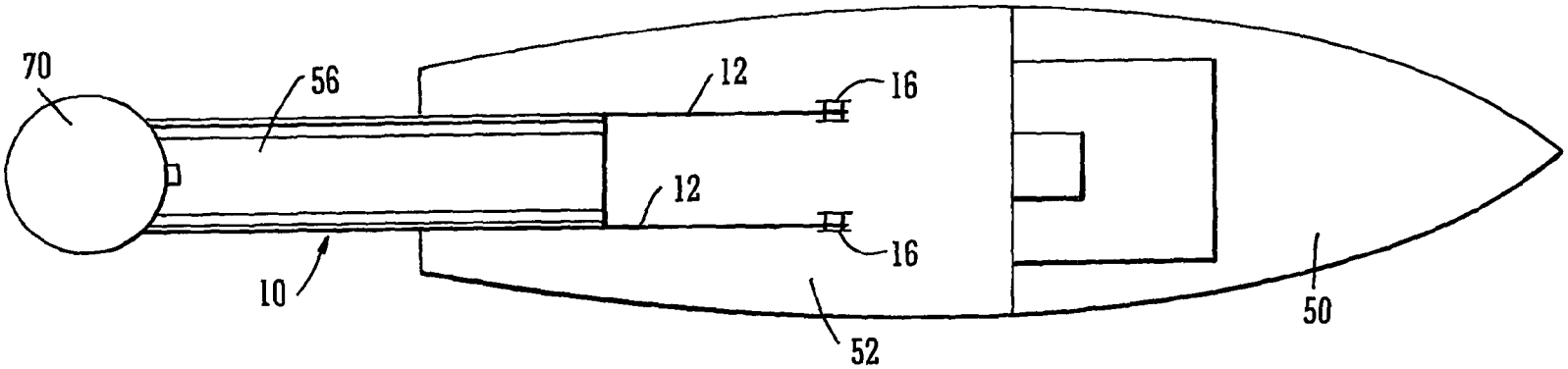
FIG. 2 is a schematic plan view of an apparatus of the invention when mounted between a transfer vessel and a fixed offshore structure.

Referring now in particular to FIGS. 1 and 2, there is shown an apparatus 10 according to one embodiment of the invention which provides a bridge for personnel to transfer on foot from a transfer vessel 50 to a fixed offshore structure 70 and vice versa. The bridge is also suitable for the transfer of goods and equipment between the transfer vessel 50 and the fixed structure 70. In the embodiment illustrated, the fixed offshore structure is a part of a wind turbine, but the fixed offshore structure could equally be a larger vessel (in relation to the transfer vessel 50), a coastal structure such as a sea wall, breakwater or jetty or even (although less likely when the transfer vessel is small such as an RIB) a vessel of similar size to the transfer vessel 50. Although not specifically illustrated, the bridge apparatus of FIG. 1 can be used to effect transfer of personnel and/or equipment between larger vessels typically of generally similar size such as cargo vessels or supply vessels. For use between two larger vessels, the bridge apparatus 10 will typically have broadly the same construction as a bridge apparatus 10 for use between a transfer vessel 50 and a fixed structure 70, but on a larger scale to provide a higher carrying capacity. A typical carrying capacity for transfer of equipment between vessels is about 6 tonnes.

When installed between the transfer vessel 50 and the fixed offshore structure 70, the apparatus 10 provides a means by which personnel such as commissioning or maintenance personnel for a wind turbine can step between the transfer vessel 50 and the fixed structure 70 with greater safety and in a wider range of sea conditions and also a means by which maintenance or repair equipment can be transferred from the transfer vessel 50 to the fixed structure 70. At its point of attachment to the fixed structure 70, the relative motion of the apparatus 10 with respect to the fixed structure 70 is slight, or even negligible, and similarly the relative motion between the apparatus 10 and the vessel 50 at the point where the apparatus 10 meets the vessel is minimised, despite the fact that the transfer vessel may be pitching, rolling or moving back and forth by action of the waves on the vessel 50. Thus the health and safety risks associated with stepping from a vessel 50, moving unpredictably because of wave motion, to the fixed structure 70 are eliminated.

In summary, the apparatus 10 uses one or more tensioned ropes 12 extending between the vessel 50 and the fixed structure 70 from which one or more inflatable members are suspended. When inflated, the inflatable members 14 extend from the vessel 50 to the fixed structure 70 and provide a safe walkway for the transfer of personnel. Also, the vessel 50 is allowed considerable freedom of movement in maintaining its station with respect to the fixed structure 70, which allows the vessel operator to adjust the position and/or heading of the vessel to accommodate prevailing weather conditions. Further, in the unlikely event that the apparatus 10 should fail, the apparatus falls into the water and, because of the inflatable member(s) 14, the apparatus floats, so providing a safe refuge for personnel until rescue can be effected.

In use of the apparatus of this embodiment for transfer between a transfer vessel 50 and a fixed structure, the apparatus 10 is provided in its compact (non-inflated) state on the transfer vessel 50. The transfer vessel 50 is brought a location proximate the fixed structure 70 and at least one, but preferably two wires 12 carried by the vessel 50 are connected to the fixed structure 70 at a suitable location 74 of entry onto the structure, such as a ladder 72 or platform on the fixed structure 70. The location 70 is most preferably at a point which is above the maximum wave height In the prevailing conditions. On the transfer vessel 50 the wires 12 are attached to means for maintaining a substantially constant tension in the wires 12. Suitable means include winches 16 fitted with constant tension devices. Such winches 16 are known in the art.

When connection by means of wires 12 between the transfer vessel 50 and the fixed structure 70 has been established, the transfer vessel may adjust Its location to a position further away from the fixed structure 70. In the chosen location, the transfer vessel 70 thrusts away from the fixed structure 70 but is restrained from moving away by the wires 12. Thus the desired tension is maintained in the wires 12.

In use of the apparatus of this embodiment for transfer between two vessels, the apparatus 10 is provided in its compact (non-inflated) state on a first one of the vessels. The vessels are brought to relative locations proximate one another and at least one, but preferably two wires 12 carried by the first vessel are connected to the second vessel at a suitable location of entry onto the second vessel, such as a ladder or platform or entry port on the second vessel. The location of entry is most preferably at a point which is above the maximum wave height in the prevailing conditions. On the first vessel the wires 12 are attached to means for maintaining a substantially constant tension in the wires 12. Suitable means include winches 16 fitted with constant tension devices. Such winches 16 are known In the art.

When connection by means of wires 12 between the respective vessels has been established, one or both of the vessels may adjust its location to a position such that the vessels are spaced further apart and the vessels then maintain their station with respect to one another. The winches accommodate some relative movement between the vessels while maintaining the desired tension in the wires 12.

The apparatus 10 comprises a plurality of slidable fixings 18 through which a wire 12 passes. The slidable fixings 18 connect the inflatable members 14 to the wire(s) 12, whereby the inflatable members 14 may be suspended from the wire(s) 12. The slidable fixings 18 may conveniently include rings through which a wire 12 passes. To establish the walkway between the transfer vessel 50 and the fixed structure 70, or between respective vessels, the inflatable members 14 are inflated with a suitable inflation fluid which is most conveniently air. The air may be pumped into the inflatable members 14, or may be supplied form an air storage source such as compressed air cylinders.

The inflatable members 14 each take the form of a longitudinally extensive tube which, when extended, spans the gap between the transfer vessel 50 and the fixed structure 70 or between respective vessels. The tubes are preferably independently inflatable, so that any inflation failure of one tube does not cause failure of others of the inflatable tubes 14. Thus, inflation of the inflatable members causes the slidable fixings 18 to slide along the wire(s) 12 as the inflatable members extend, until the inflatable members 14 are fully extended and suspended from the guide wire(s) 12. Thus, in its inflated state, the apparatus 10 of the invention, and in particular the inflatable members 14, extend from the vessel to the point of entry 74 to the fixed structure 70 or to the second vessel. In this state, the inflatable members 14 may be fixedly secured to the guide wire(s) 12 to prevent any retraction of the inflatable members 14.

In a preferred arrangement, safety ropes may be provided substantially co-extensive with the inflatable members 14 to which safety harnesses worn by personnel may be attached during transfer across the apparatus 10.

In using the apparatus 10, personnel step onto a surface defined (or supported) by an inflatable member 14. This transition is made from a safe area well within the deck area 52 of the transfer (or first) vessel 50, so that in the event of any slip or trip at this stage the person 54 remains on the deck 52. Personnel then move along the apparatus 10 by walking along the surface 56 until they reach the entry location 74 of the fixed structure or second vessel where they can safely step onto the access ladder 72, platform or deck before uncapping their safety harness. The step onto the entry location 74 is easy in the absence of any significant relative motion between the apparatus (bridge structure) 10 and the fixed structure 70 or second vessel (as appropriate).

Figure 4:
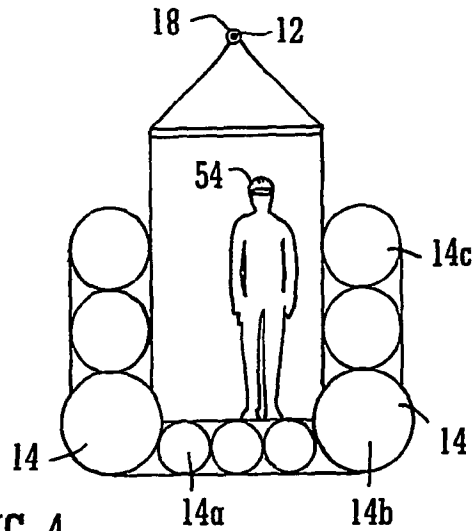
FIGS. 3 and 4 are schematic cross sections through typical embodiments of the apparatus of the invention.
Figure 3:
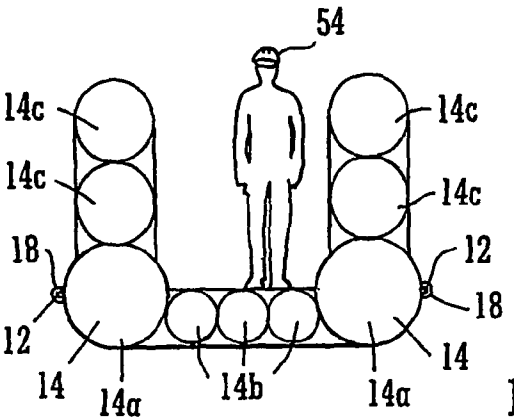

Referring in particular to FIGS. 3 and 4 it can be seen that the apparatus 10 of the invention may comprise a plurality of inflatable members 14*a*, 14*b* and 14*c*. In the embodiment of FIG. 3, principal inflatable members 14*a* are attached to the slidable fixings which in turn are supported on a pair of guide wires 12. Inflatable members 14*b* define the surface on which personnel 54 may walk across the apparatus 10 and inflatable members 14*c* define side walls which assist in preventing personnel 54 from falling from the structure.

The construction of the embodiment in FIG. 4 is similar, except that the inflatable members are suspended via slidable fixings 18 from a single guide wire 12. In each of the embodiments of FIGS. 3 and 4 the individual inflatable members 14 may be joined one to another, but each is most preferably independently inflatable.

Although the apparatus 10 of the invention has been principally described above as employing a plurality of inflatable members 14, in another preferred and advantageous embodiment a single inflatable member 14*d* may be used. Such a construction is illustrated in FIGS. 5, 8*a*, 8*b* and 10. In this embodiment, an upper part of the inflatable member 14*d* provides a surface on which personnel 54 may traverse the apparatus 10. In preferred arrangements, this upper surface may be provided with a non-slip surface, such as a non-slip coating. In alternative arrangements, a surface 58 on which personnel 54 walk may be supported by an upper surface of the inflatable member 14*d*. Ideally in this embodiment, a plurality of upright posts 56 attached at intervals to said inflatable member 14*d* is provided and ropes or nets 57 are attached to said posts 56. The upright posts 56 may, for example, be attached in fixed relation to some of the slidable fixings 18, for example to every third fixing 18. In this way, when the apparatus 10 is in its compacted state, the upright posts 56 lie in close proximity to one another and become spaced apart as the inflatable member 14*d* achieves its expanded state (see in particular FIGS. 10*a* to 10*c*). Alternatively, the upright posts 56 may be separately attachable to the inflatable member 14*d* after its expanded state has been reached. Ropes or nets 57 extending between the upright posts 56 assist in preventing personnel 54 from falling from the apparatus 10 when traversing it, and a safety rope may be provided, attached for example to first and last upright posts 56, to which a safety harness be clipped. Cross members 60 may be provided which extend laterally between respective pairs of upright posts 56 for assisting in retaining the upright posts 56 in their desired position.

FIGS. 5 to 10 illustrate in particular mounting means 80 for use with certain embodiments of the apparatus of the present invention which provides compliant freedom for the transfer vessel 50 with respect to the apparatus 10, so that the transfer vessel 50 can surge, traverse back and forth, pitch and roll with respect to the apparatus 10, in response to wave movement to which the transfer vessel 50 is subject, without adversely affecting the apparatus 10, its mountings or the fixed structure 70 and, more especially in the case of smaller transfer vessels 50 such as RIBs, without allowing the apparatus 10 to adversely affect the transfer vessel 50. Similarly, the mounting means 80 assists in accommodating relative movement between first and second vessels when the apparatus of the invention is used for transfer between vessels.

Figure 5:
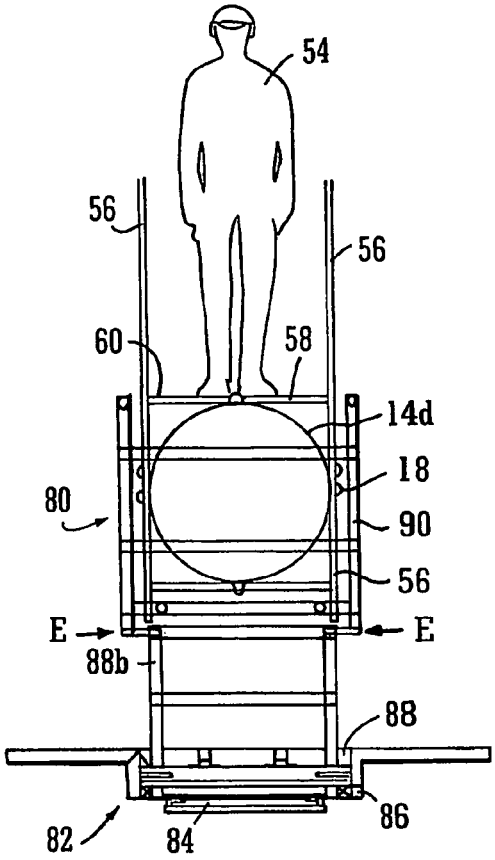
FIG. 5 is a schematic end view of a mounting means according to the invention when attached to an apparatus of the invention.
Figure 7:
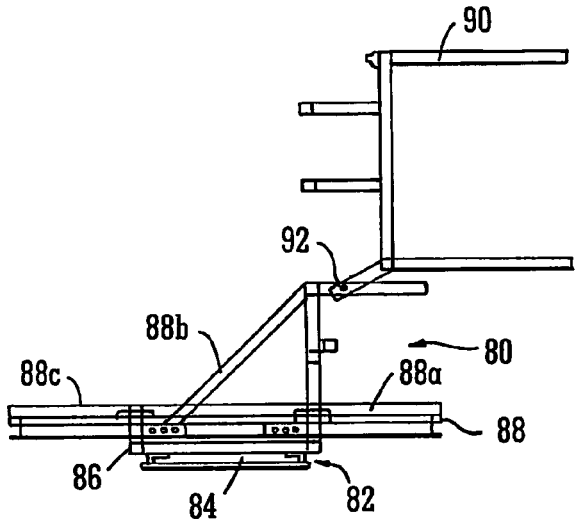
FIG. 7 is a side view of the apparatus of FIG. 5.
Figure 6:
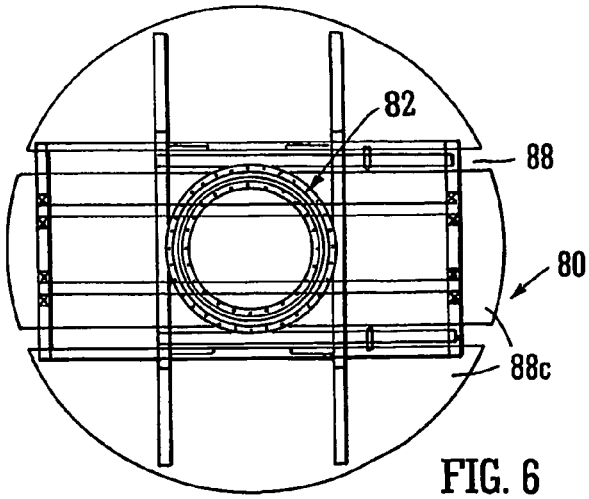
FIG. 6 is a schematic plan view of the apparatus of FIG. 5.
Figure 8A:
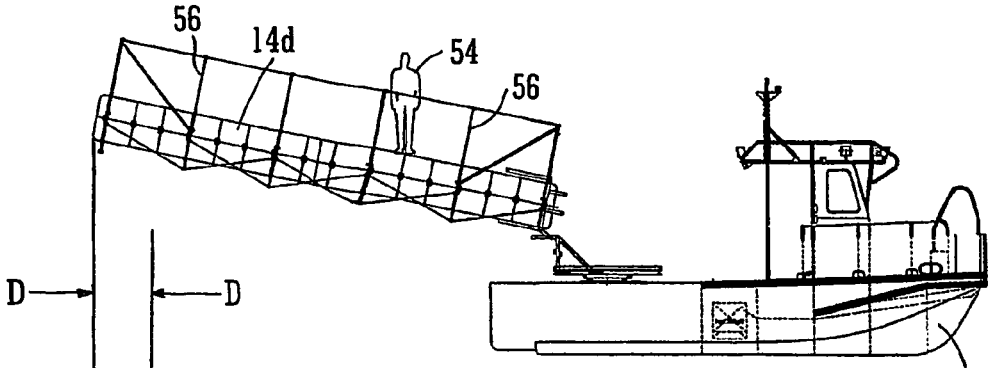
FIGS. 8*a* and 8*b* are diagrammatic side views of an apparatus and mounting means according to the invention when arranged on a transfer vessel.
Figure 8B:
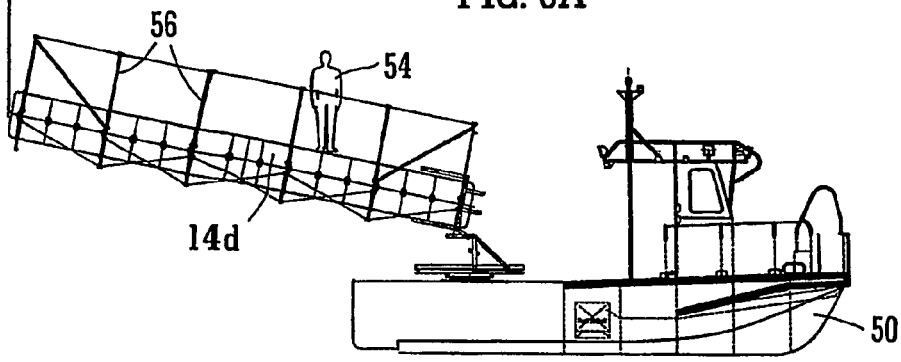
Figure 9:
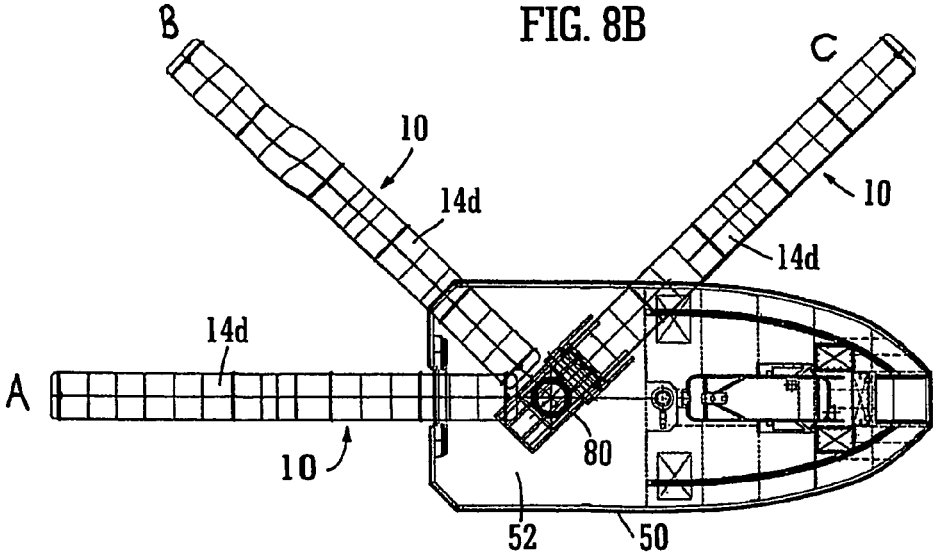
FIG. 9 is a diagrammatic plan view of an apparatus and mounting means according to the invention when arranged on a transfer vessel.

Referring in particular to FIGS. 5 to 7 the mounting means 80 comprises a first mounting element 82 which provides the transfer vessel 50 and the apparatus 10 with rotational freedom with respect to one another. The first mounting element 82 comprises a first mounting component 84 which is fixedly attached to the deck of the transfer vessel 50 and a second mounting component 86, attached to the first mounting component and which also is (indirectly) attached to the apparatus 10. The mounting components 84, 86 have rotational freedom with respect to each other. A preferred form of the first mounting element 82 is a slew ring bearing. Thus, by means of the first mounting element 82, after the apparatus 10 of the invention has been attached to the fixed structure 70, the transfer vessel 50 is free to adopt a suitable heading, during the transfer of personnel 54, or goods or equipment, to favour the weather or sea conditions. A range of different headings is illustrated by positions A, B and C of the apparatus 10 in FIG. 9. The heading is typically determined by weather, waves, currents or obstructions at the transfer site.

The arrangement in relation to use of the apparatus of the invention for transfer between vessels is similar. The first and second mounting components 84, 86 accommodate differences in the course or heading of the vessels and also accommodate relative forward and back motion between the vessels.

Attached to the second mounting component 86 is a first frame element 88. The first frame element includes first and second parts 88*a*, 88*b* which are slidably mounted with respect to one another. Specifically, part 88*a* is mounted in fixed relation to second mounting component 86 and part 88*b* is free to execute translational movement with respect to part 88*a*. The translation freedom of the part 88*b* with respect to part 88*a* accommodates the back and forth movement of the transfer vessel 50 with respect to the apparatus 10, as can be seen from a comparison of FIGS. 8*a* and 8*b*. The permitted movement of the vessel which is accommodated is indicated by arrows D-D. Similarly, for transfer between two vessels using the apparatus of the invention, the second mounting component 86 and frame element 88 accommodate relative motion of the vessels towards and away from one another.

In a preferred embodiment, a bias is applied to the second frame element part 88*b*, most preferably to urge the part 88*b* towards the mid point of its permitted translational motion. Suitable biasing means include elastic cord (e.g. shock cord) or rate controlled damping systems. One important objective of the biasing means is to provide a method of force limitation to prevent excessive force being applied to the vessel. The bias forces applied to the part 88*b* may be symmetrical or asymmetrical with regard to the two opposed direction of permitted movement of the part 88*b*.

Locking means may be provided to independently lock the first mounting element 82 to prevent rotational movement and/or to lock the part 88*b* with respect to part 88*a* to prevent translational movement, as may be desirable for transport storage or stowage of the apparatus 10.

An upper part of the component 88*a* may preferably define a surface 88*c* on which personnel may stand before stepping onto the apparatus 10. Although the surface 88*c* may itself be subject to translational and or rotational movement, there is little, if any, movement with respect to the apparatus 10. Thus stepping from the deck 52 onto the surface 88*c* is simple, as is stepping from the surface 88*c* onto the apparatus 10.

A second frame element 90 is attached to the end of the apparatus 10 to support the apparatus 10 in use. The second frame element 90 is also pivotally connected at 92 to the first frame element part 88*b*, so that the second frame element 90 and the first frame element part 88*b* pivot with respect to one another about an axis E-E which is nominally horizontal and which is substantially perpendicular in use to the longitudinal axis of the inflatable member(s) 14. "Nominally horizontal" is used in the sense that the pivot axis would be substantially horizontal when the transfer vessel 50 (or first vessel) is on a flat calm sea. Of course, in more usual sea conditions, some variation from the true horizontal is inevitable. The pivotal connection 92 accommodates pitch and roll of the transfer vessel 50 caused by wave motion. Similarly, when the apparatus of the invention is used for transfer between tow vessels the pivotal connection 92 accommodates relative upward and downward movement of the respective vessels and rolling motion of the first vessel.

Figure 10C:
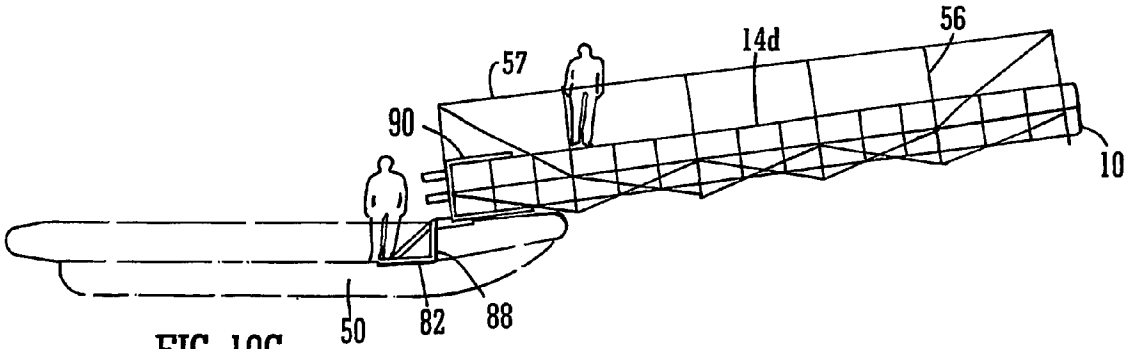
FIGS. 10*a* to 10*c* show diagrammatically the deployment of the apparatus of the invention from an RIB.
Figure 10B:
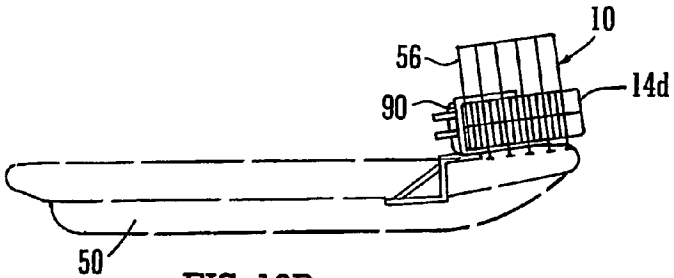
Figure 10A:
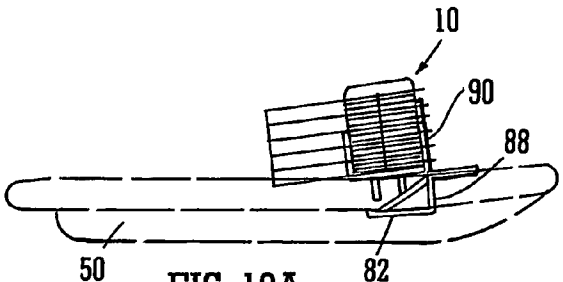
Figure 11:
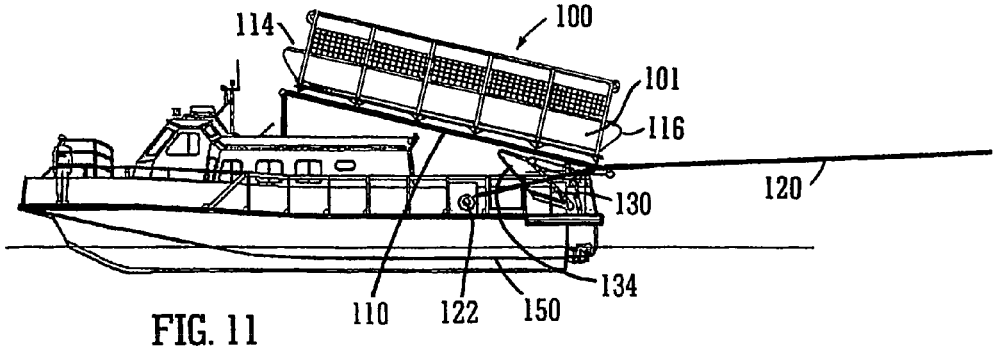
FIG. 11 is a diagrammatic side view of an apparatus according to another embodiment of the invention when mounted on a transfer vessel.
Figure 12:
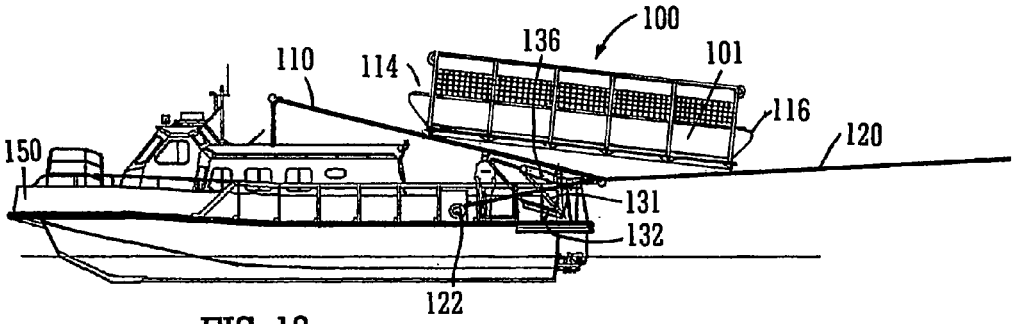
FIG. 12 is a diagrammatic side view of the apparatus of FIG. 11 when partially deployed.

Further, the pivotal connection 92 may allow the apparatus 10, in its compact state, to be retained in a safe stowage position as indicated in FIG. 10*a*. When required for use, the apparatus 10, supported in second frame element 90 may be pivoted about axis E-E to its use position (FIG. 10*b*), prior to inflation of the inflatable member(s) 14 (FIG. 10*c*).

In preferred arrangements using the mounting means 80, the wires 12 may terminate on the second frame element 90. The connection between the wires 12 and the second frame element 90 may desirably be designed to break at a predetermined force in order to limit tensile forces applied to the transfer vessel 50 by the apparatus 10 in use, or similarly forces between a first vessel and a second vessel. Also, the attachment between the end of the apparatus 10 and the second frame element 90 may desirably be designed to fail in the event of excessive force, thereby to allow the vessel to move away from the apparatus 10 (or the first and second vessels to move apart), for example in severe weather conditions.

Although the mounting means 80 has been primarily described in relation to an apparatus 10 comprising a single inflatable member 14*d*, the mounting means are also suitable for use with apparatus 10 including a plurality of inflatable members 14, such as are illustrated in FIGS. 3 and 4.

An alternative embodiment of the apparatus of the invention is shown in FIGS. 11 to 20. In this alternative embodiment, the apparatus 100 includes a bridge member 101 which is maintained in its inflated state for all or part of its working or operational period, that is, in addition to the specific time when the apparatus is disposed between a transfer vessel 150 and a fixed structure 170. For example, a work site where the apparatus 100 of this embodiment of the invention is deployed may include a number of fixed structures 170, such as wind turbines, to or from which personnel are transferred at various times during the operational period. Likewise, transfer may be required on one occasion to a fixed structure 170 and on a subsequent occasion to a second vessel. In this case it is inconvenient to deflate and re-inflate the apparatus 100 each time it is moved between one fixed structure 170 or vessel and another. Accordingly, in this embodiment of the invention the apparatus 100 (more specifically, the bridge member 101) is maintained in its inflated state at least for movement of the apparatus 100 from one fixed structure 170 to another fixed structure 170. For longer movements, e.g. journeys to the work site from the transfer vessel's home port, the apparatus 100 may be in its deflated state. This embodiment is also applicable to apparatus of fixed construction, that is, apparatus which in which the bridge member 101 is not inflatable/deflatable or otherwise changeable between expanded and compact states.

In accordance with this embodiment of the invention, the bridge member may comprise a single inflatable member or multiple inflatable members generally as described above, in particular with reference to FIGS. 3 and 4. The transfer vessel 150 is provided with at least one runway or slider 110 on which one part, preferably an end portion, of the bridge member 101 is mounted. The slider 110 is preferably a rigid rail or, more preferably, a pair of rails, on which the bridge member 101 is slidably mounted. The rails are preferably rectilinear, but may, if appropriate, be curved. In other constructions, the slider may be, for example, one or more tensioned wires or cables. In FIGS. 14 to 20, a pair of rails 111, 112 is shown.

Figure 13:
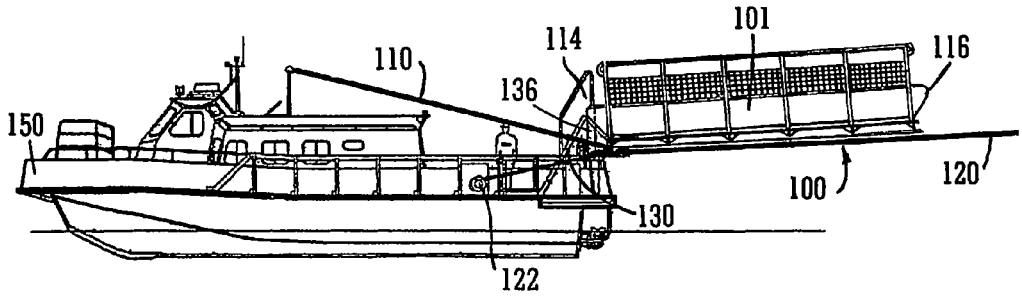
FIG. 13 is a diagrammatic side view of the apparatus of FIG. 11 when fully deployed.

Rails 111, 112 are fixedly mounted on the transfer vessel 150. In the illustrated example, the rails 111, 112 extend in parallel from a highest point near the central region of the vessel 150 to a lowest point near the stern of the vessel 150. As can be seen in particular in FIG. 11, the bridge member 101 is carried during movement of the vessel between fixed structures 170 (and during any other movements, as required) on the rails 111, 112 so that one end 114 of the apparatus is towards the upper and of the rails 111, 112 and one end 116 of the apparatus is towards the lower end of the rails 111, 112. The end 114 of the bridge member 101 is preferably permanently attached to the rails 111, 112 and most preferably remains so attached when the bridge member is deployed, that is, in its condition of use (FIG. 13). However, a releasable attachment is not precluded. The end 114 is attached by suitable means (not specifically shown) such as casters, which allow the end 114 to slide up and down the rails 111, 112 when required to do so. The end 116 may preferably be (but need not be) releasably secured to the rails 111, 112.

For deployment of the apparatus 100, firstly the guide wire or wires 120 are secured to the fixed structure 170, preferably by one of the methods as described below. If not already (i.e. permanently or semi-permanently) attached, the end 116 of the bridge member 101 is attached to the or each guide wire 120. For the purposes of this example of the apparatus, it is assumed that there are two guide wires 120. For example, the end 116 of the bridge member 101 may include one or more slots channels or other passageways through which the guide wires 120 pass. From the position shown in FIG. 11, the bridge member 101 is caused to slide down the rails 111, 112 so that end 116 moves along the guide wires 120. For example, the bridge member 101 may be moved with respect to the rails 111, 112 by means of a winch and cable arrangement, or other suitable means. The bridge member 101 is so moved until the end 114 is at or near the end of the rails 111, 112 at which point it reaches its maximum extension with respect to the transfer vessel 150, as depicted in FIG. 13. The position of the transfer vessel 150 is continuously monitored and adjusted as necessary so that the end 116 of the bridge member 101 is located in the desired position with respect to the fixed structure 170 so that personnel may transfer easily from the apparatus 100 to the fixed structure and likewise so that goods or equipment may be transferred. In preferred arrangements, the guide wires 120 are connected, on the transfer vessel 150, to winches 122, preferably constant tension winches whereby the transfer vessel 150 is maintained in approximately constant relation to the fixed structure 170 by adjustment of the length of the guide wires 120.

In a preferred embodiment, the transfer vessel 150 is provided with a foldable or collapsible ladder 130 which is stowed below the line of rails 111, 112 when not required for use, so as not to interfere with the deployment of the bridge member 101. In the illustrated example, the ladder 130 is in two parts 131, 132 which are pivoted with respect to one another and are connected by a linkage 134. Linkage 134 is connected to a pivoting post 136 which pivots about an axis at 138 to move the ladder 130 from its stowed to its deployed position.

Figure 14:
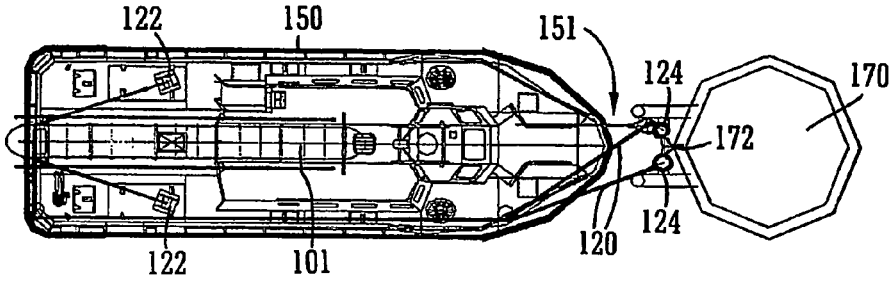
FIGS. 14, 15 and 16 are diagrammatic plan views showing stages in the attachment of guide wires from a transfer vessel to a fixed structure, in accordance with the invention.
Figure 15:
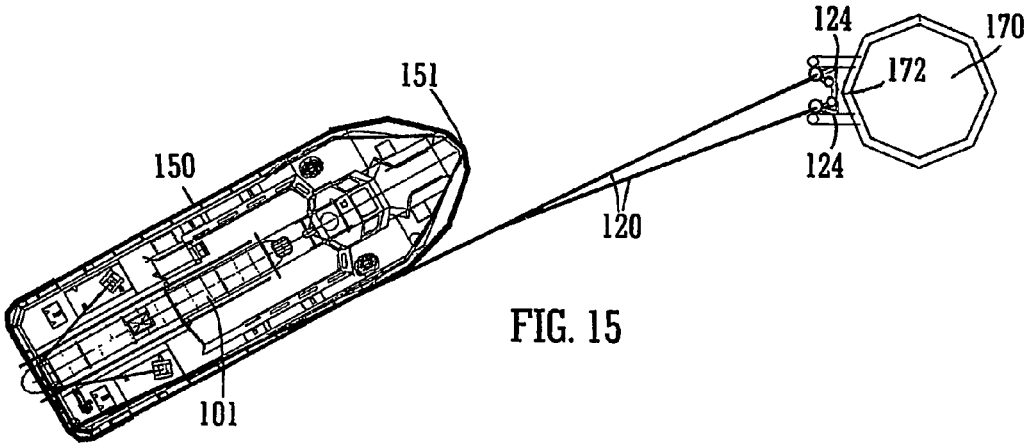
Figure 16:
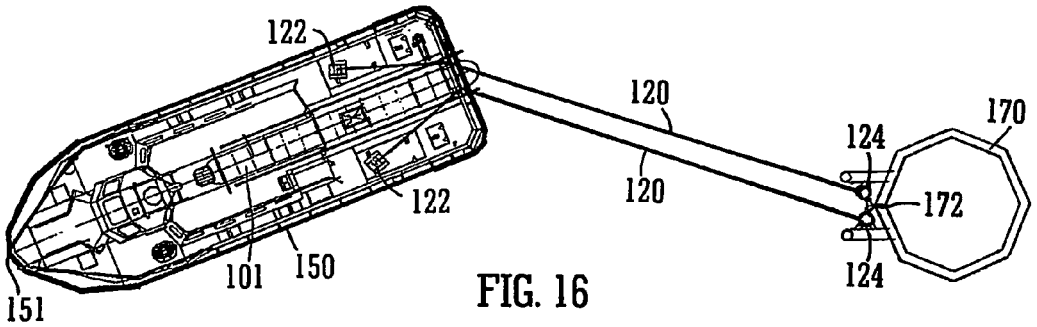
Figure 17:
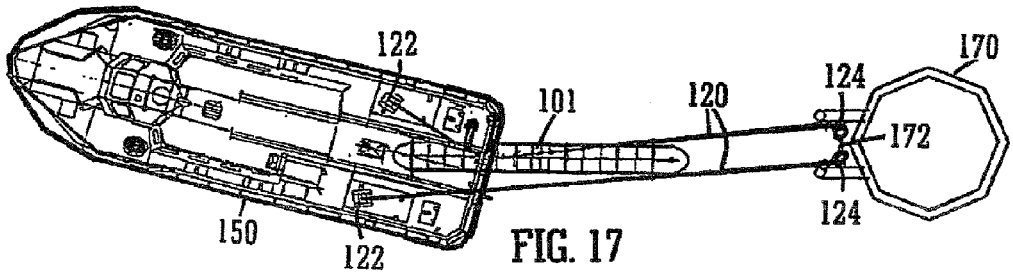
FIG. 17 is a diagrammatic plan view of a transfer vessel and an apparatus of FIG. 11, in a partially deployed state.
Figure 18:
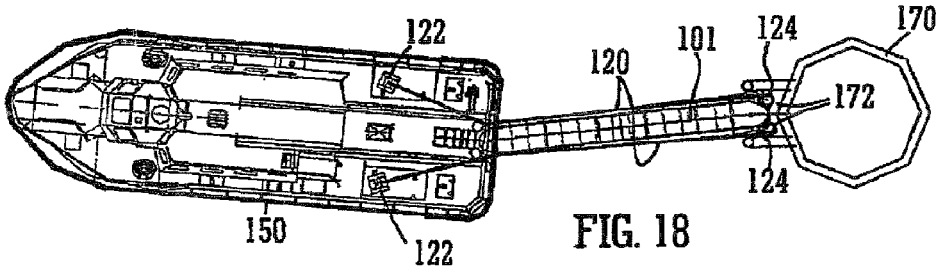
FIG. 18 is a diagrammatic plan view of a transfer vessel and an apparatus of FIG. 11 in a fully deployed state.

FIGS. 14, 15 and 16 illustrate one method by which guide wires 120 are attached to fixed structure 170. In FIG. 14, the transfer vessel 150 is shown approaching the fixed structure 170, with its bow 151 leading. When the transfer vessel 150 is proximate the fixed structure 170, guide wires 120 are attached to suitable attachment points on the fixed structure 170. As indicated above, the attachment points are so located that when the apparatus 100 is deployed, personnel may transfer safely from the apparatus 100 (bridge member 101) onto the fixed structure 170. Thus, in particular, the attachment points will normally be so located that the deployed bridge member 101 is above the maximum wave height. In the example of FIGS. 14 to 18, two guide wires 120 extend in parallel from the transfer vessel 150 to the fixed structure 170. Each guide wire 120 includes a loop 124 at its end which is simply placed over, on or around an appropriate attachment point 172 on the fixed structure 170. The attachment point 172 may, for example include a locking or latching means which secures the loop 124 from becoming unintentionally detached.

As indicated in FIGS. 15 and 16, after the guide wires 120 have been attached to the fixed structure 170, the transfer vessel 150 is turned and manoeuvred into its desired alignment and position with respect to the fixed structure 170. The alignment of the transfer vessel will depend on factors such as wind and sea conditions. The apparatus 10, 100 is then deployed as described above.

Figure 19:
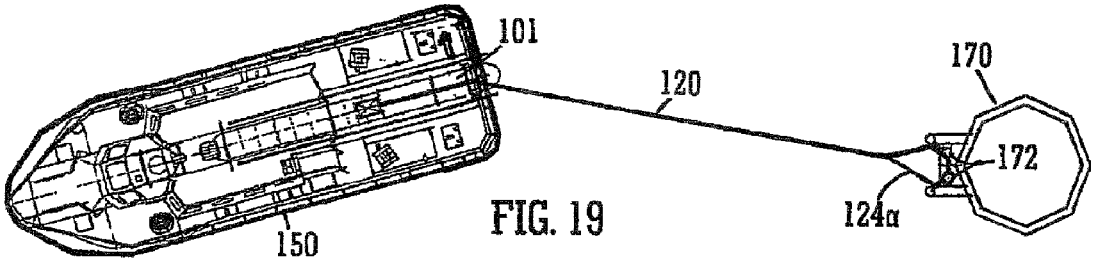
FIG. 19 is a diagrammatic plan view showing an alternative arrangement of a guide wire extending between a transfer vessel and a fixed structure.

An alternative arrangement is shown in FIG. 19 in which only one guide wire 120 is used. The guide wire 120 includes a single loop 124*a* at its end which is placed over, on or around one or more suitable attachment means 172.

Figure 20:
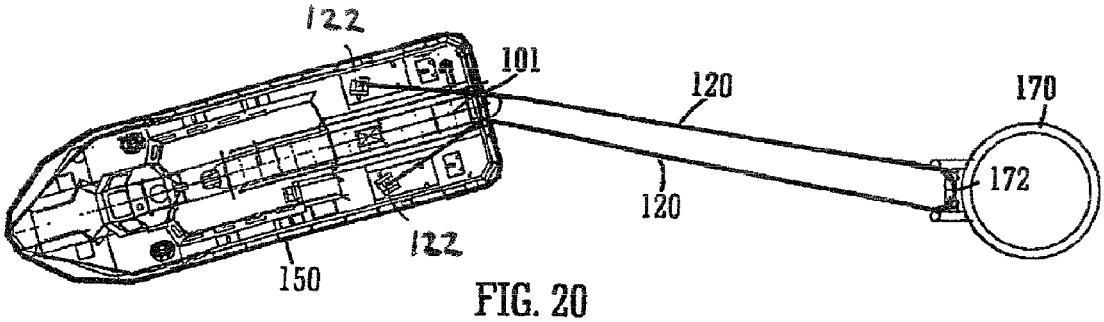
FIG. 20 is a diagrammatic plan view showing a further alternative arrangement of a guide wire extending between a transfer vessel and a fixed structure.

A further alternative arrangement is shown in FIG. 20 in which a single guide wire 120 is also used. In this case, the guide wire has no loop 124. Rather, the leading end of the guide wire 120 is passed through suitable attachment means 172 on the fixed structure 170 and then returned to the vessel where it is preferably connected to a winch 122.

The apparatus 100 with bridge structure 101 is also suitable for use in transferring personnel and/or equipment between vessel at sea. In this case, the apparatus 100 is mounted on a first of the vessels. The runway 110 (with rails 111,112) need not be arranged in a fore-and-aft alignment with respect to the first vessel. For example the runway 110 may be in an alignment abeam of the vessel to facilitate transfer between vessels located side by side. The guide wire or wires 120 are secured between the vessels, preferably using one of the arrangements described above (FIGS. 17 to 20, where the second vessel takes the place of fixed structure 170), and the bridge structure 101 is caused to slide along the runway 110 and the guide wire(s) 120 thereby to span the gap between the vessels. As noted above, movement of the bridge structure 101 is preferably by means of a winch and cable arrangement. Preferably constant tension winches are used to maintain the guide wire or wires 120 at a desired tension. Preferably, the bridge structure 101 is inflatable and deflatable to minimise its volume when stowed.

The invention claimed is:

1. A method of providing access from a vessel navigable under its own power to a fixed offshore structure, comprising:

providing a gangway apparatus in a stored condition on the vessel, the gangway comprising at least one inflatable member in the form of a longitudinally extensible tube;

maneuvering the vessel so that it is proximate the fixed offshore structure;

providing at least one guide wire attached to the vessel, the gangway apparatus being attached or attachable to a said guide wire by means of one or more slidable fixings;

extending the at least one guide wire from the vessel and connecting the at least one guide wire between a location on the vessel and an attachment location on the fixed offshore structure proximate a location of entry to the fixed offshore structure;

controlling and, where necessary, adjusting the position of the vessel so that it is maintained in spaced apart relation to the fixed offshore structure, and maintaining the at least one guide wire at a desired tension;

extending the gangway apparatus from the stored condition by inflating said at least one inflatable member to a use condition by sliding the slidable fixing(s) along a said guide wire until the at least one inflatable member spans the gap between the vessel and location of entry to the fixed offshore structure.

2. A method as claimed in claim 1 comprising:

providing two guide wires and connecting said guide wires between a location on the vessel and points on the fixed offshore structure proximate the location of entry to the second marine structure.

3. A method as claimed in claim 2 comprising providing a single inflatable member with a guide wire at respective sides thereof.

4. A method as claimed in claim 1 further comprising:

providing the first marine structure with a linear runway and mounting the gangway apparatus on the runway in its stored condition and, when the gangway apparatus is required for use, causing the gangway apparatus to slide along the runway.

5. A method as claimed in claim 4 wherein the gangway apparatus slides along the runway contemporaneously with the step of sliding the gangway apparatus along the guide wire(s).

6. A method as claimed in claim 4 wherein at least one end portion of the gangway apparatus remains connected to the runway when the gangway apparatus is in its use condition.

7. The method of claim 1, further comprising:

sequentially attaching the gangway apparatus to one or more additional fixed offshore structures.

* * * * *